US012644292B2

(12) United States Patent
Sanborn

(10) Patent No.: US 12,644,292 B2
(45) Date of Patent: Jun. 2, 2026

(54) WINDOW WELL SYSTEMS

(71) Applicant: Torrey Sanborn, Larkspur, CO (US)

(72) Inventor: Torrey Sanborn, Larkspur, CO (US)

( * ) Notice: Subject to any disclaimer, the term of this patent is extended or adjusted under 35 U.S.C. 154(b) by 153 days.

(21) Appl. No.: 18/592,232

(22) Filed: Feb. 29, 2024

(65) Prior Publication Data

US 2024/0218677 A1 Jul. 4, 2024

Related U.S. Application Data

(63) Continuation-in-part of application No. 17/546,164, filed on Dec. 9, 2021, now Pat. No. 11,939,779.

(51) Int. Cl.
*E04F 17/06* (2006.01)

(52) U.S. Cl.
CPC ..... *E04F 17/06* (2013.01)

(58) Field of Classification Search
CPC ..... E04F 17/00; E04F 17/06; E04B 2/18
USPC ..... 52/107, 20, 592.6
See application file for complete search history.

(56) References Cited

U.S. PATENT DOCUMENTS 1,329,292 A * 1/1920 Christin ..... E04C 2/06 249/98
1,840,397 A * 1/1932 Keyes ..... E04F 17/06 52/712
1,928,547 A * 9/1933 Winnie ..... B65D 9/32 217/17
2,162,628 A * 6/1939 Martin ..... E04F 17/06 52/107
2,453,609 A * 11/1948 Whitehouse ..... E04F 17/06 52/107
2,898,638 A * 8/1959 Druckhamer ..... E04F 17/06 52/107
3,004,634 A * 10/1961 Evans ..... E04F 17/06 D25/48.8
4,704,828 A * 11/1987 Kemp ..... E04F 17/06 403/345
5,107,640 A * 4/1992 Gefroh ..... E04F 17/06 52/107
5,387,380 A * 2/1995 Cima ..... B33Y 10/00 264/109
6,321,496 B1 * 11/2001 Martin, Jr. ..... E04B 2/8629 52/439
6,484,455 B1 * 11/2002 Poole ..... E04F 17/06 52/107
6,880,300 B2 * 4/2005 Hawkes ..... E04F 17/06 52/741.11

(Continued)

*Primary Examiner* — James M Ference
(74) *Attorney, Agent, or Firm* — Jerome Drabiak; EDISON LAW GROUP

(57) ABSTRACT

A window well system including at least two window-well modules designed to be stacked is disclosed. Each module has a curved wall including an inner wall section, outer wall sections, an upper surface section unitary with the inner wall section, and a base having several indentations arranged along its underside. Of the outer wall sections, an upper outer wall section is unitary with the upper surface section. Between the upper outer wall section and a lower outer wall section is a curvilinear horizontal ledge. Between the inner and outer wall sections is an air space. Along the horizontal ledge are several projections oriented upwardly and sized and configured to mesh with and fit into the indentations formed in the base of a like window well module to be placed on the upper surface section.

5 Claims, 16 Drawing Sheets

(56) References Cited

U.S. PATENT DOCUMENTS 6,915,612 B2 * 7/2005 Oakley ..... E04F 17/06 52/107
7,141,201 B2 11/2006 Kim et al.
7,171,786 B2 2/2007 George
7,444,784 B2 * 11/2008 Brown ..... E06B 5/01 292/268
7,549,256 B1 * 6/2009 Watkins ..... E06C 9/02 52/107
7,627,992 B1 * 12/2009 Gavin ..... E02D 29/12 52/592.6
7,707,786 B2 * 5/2010 Theophilus ..... E04F 17/06 52/584.1
7,716,879 B2 5/2010 George
7,730,673 B2 * 6/2010 George ..... E04F 17/06 52/246
7,730,674 B1 * 6/2010 Gernstein ..... E04F 17/06 52/107
7,802,402 B2 * 9/2010 Skaggs ..... E02D 29/12 52/107
7,861,468 B1 * 1/2011 Gernstein ..... E04F 17/06 52/107
7,958,692 B2 6/2011 George
7,966,776 B2 * 6/2011 Cook ..... E04F 17/06 52/309.1
8,091,292 B1 * 1/2012 Jalbert ..... E04F 17/06 49/54
8,250,815 B2 * 8/2012 Siepel ..... E04F 17/06 52/107
8,578,662 B1 * 11/2013 Monk ..... E04F 17/06 52/107
8,690,359 B1 * 4/2014 Clock ..... G02B 23/08 359/402
9,816,315 B1 * 11/2017 Price ..... E04F 17/06
10,662,708 B2 * 5/2020 Snarr ..... E06C 9/10
11,939,779 B2 * 3/2024 Sanborn ..... E04F 17/06
2003/0182877 A1 * 10/2003 Worth ..... E04F 17/06 52/107
2004/0083661 A1 * 5/2004 Hawkes ..... E04F 17/06 52/741.11
2004/0098929 A1 * 5/2004 Kim ..... E04F 17/06 52/107
2005/0115169 A1 * 6/2005 George ..... E04F 17/06 52/107
2007/0089373 A1 * 4/2007 Heady ..... E04F 17/06 52/107
2008/0010911 A1 * 1/2008 George ..... E04F 17/06 52/107
2008/0209823 A1 * 9/2008 Gernstein ..... E04F 17/06 52/107
2010/0205897 A1 * 8/2010 George ..... E04F 17/06 52/741.11
2011/0203194 A1 * 8/2011 Kelsch ..... E04F 17/06 52/173.1
2011/0271620 A1 * 11/2011 Brewka ..... E04G 13/06 249/13
2011/0302853 A1 * 12/2011 Wiwi ..... E04F 17/06 52/107
2021/0164240 A1 * 6/2021 Cook ..... E04F 17/06
2021/0172180 A1 * 6/2021 Cook ..... E04F 17/06
2021/0207387 A1 * 7/2021 Cook ..... E04F 17/06
2023/0183989 A1 * 6/2023 Sanborn ..... E04F 17/06 52/107
2024/0218677 A1 * 7/2024 Sanborn ..... E04F 17/06

* cited by examiner

WINDOW WELL SYSTEMS

REFERENCE TO RELATED APPLICATION

The present application is a continuation-in-part ("CIP") of nonprovisional patent application U.S. Ser. No. 17/546,164 filed Dec. 9, 2021, incorporated by reference in its entirety for priority purposes pursuant to Title 35, US Code, Section 120.

FIELD

The present subject matter is directed, in general, to the field of window wells and is more particularly directed to below-grade vertically stackable window-egress systems.

BACKGROUND

A basement (occasionally referred to as a "cellar") may include one or more levels of a building, some of which are completely or partly below grade. The word cellar thus may apply to an entire underground level or merely to an underground room. A subcellar is a cellar that is further below grade. The term "grade" is used throughout this patent application to mean an average surface level outside a building. For certain residential buildings, a basement may be used to provide habitable space below the ground floor of buildings. Basements often include at least one window to allow natural light to enter; and such might provide access to the outside. Accordingly, while a basement can often be used in substantially the same manner as an additional above-ground floor of a building, the use of a basement depends largely on various factors including geographical regions, climate, soil conditions, seismic activity, building safety measures, and real estate codes.

Structural systems for windows provided below grade are well known. See, e.g., U.S. Pat. No. 1,840,397 to Keyes and U.S. Pat. No. 2,162,628 to Martin. Such systems, formerly known as directed to "areaway construction" are now characterized as relating to "window wells."

As a person of ordinary skill in the art can appreciate, subsequent improvements have resulted in U.S. Pat. No. 4,704,828 to Kemp; U.S. Pat. No. 6,484,455 to Poole; U.S. Pat. No. 6,880,300 to Hawkes; U.S. Pat. No. 6,915,612 to Oakley; U.S. Pat. Nos. 7,171,786; 7,716,879; 7,730,673; 7,958,692, all to George; U.S. Pat. No. 7,444,784 to Brown; U.S. Pat. No. 7,549,256 to Watkins; and U.S. Pat. Nos. 7,730,674 and 7,861,468, both to Gernstein. Further improvements resulted in U.S. Pat. No. 7,966,776 to Cook; U.S. Pat. No. 8,250,815 to Siepel; U.S. Pat. No. 8,578,662 to Monk; U.S. Pat. No. 8,690,359 to Clock; U.S. Pat. No. 9,816,315 to Price et al.; and U.S. Pat. No. 10,662,708 to Snarr. For instance, the '708 patent to Snarr is directed to a window well egress system adapted and configured for allowing a small child to use a ladder to escape from a window well; and the '315 patent to Price et al. is directed to a window well cover with a screened frame, to prevent debris from falling into a window well, while allowing natural light to enter a cellar environment. The '359 patent to Clock discloses a system for a basement window that includes a periscope-type mechanism for enabling internal occupants to view the surrounding outdoor landscape. The '662 patent to Monk discloses a window wall enclosure having attachable steps. The '815 patent to Siepel is for a window well cover; and the '776 patent to Cook is directed to a textured window well.

The '468 and '674 patents, to Gernstein, are for window well structures enabling a person to escape from a basement environment through a basement window. The '256 patent to Watkins is directed to window well modules. The '784 patent to Brown discloses a system for securing a cover or grid over a window well. The '692; '673; '879; and '786 patents, to George, disclose various window well structural details. The '612 patent to Oakley is directed to window wells said to possess in-ground stability. The '300 patent to Hawkes is directed to window wells (which include integrally formed steps) that can be manufactured from various composite materials. The '455 patent to Poole is directed to a rigid window well. The '828 patent to Kemp is directed to snap-together window wells.

SUMMARY

Accordingly, when reviewed individually or in combination, these patents do not solve problems found in many current window wells. For example, not only are window wells of the present subject matter—my present invention—made from lightweight durable materials. The present subject matter in embodiments includes a curved sidewall of one-piece construction having a smooth exterior surface that substantially reduces, or virtually eliminates, vertical load problems known to be present in prior art window wells; and the lightweight yet durable window wells of the present subject matter are stackable.

Window wells of the present subject matter include a ladder unitary-in-construction with an inner surface of the curved sidewall. Window wells of the present subject matter include a bottom region that is completely open, allowing the soil as well as any aggregate that may be present to uplift relatively freely whenever soil-uplifting conditions may occur.

Window wells of the present subject matter include many features noted in the summary. For example, horizontally oriented members (that I call "footholds") are integral structural components which provide embodiments of the window well with its structural rigidity. Additional advantages shall become clear after reading the detailed description.

A window well unit (or module) of the present subject matter is characterized as comprising at least two, and preferably several, window-well modules that are designed to be vertically stacked. Each module has a curved wall that includes an inner wall section, at least two outer wall sections, an upper surface section that is unitary with the inner wall section, and a curvilinearly disposed base having several "cavities" (or indentations) or predetermined depth arranged along its underside. Of the at least two outer wall sections, an upper outer wall section is unitary with the upper surface section (which serves as an upper wall). Between the upper outer wall section and a lower outer wall section is a curvilinear horizontally disposed ledge. Between the inner and outer wall sections is an air space. Along the ledge are several "teeth" (or projections) of predetermined height oriented upwardly. The projections are sized and configured to mesh with and fit into indentations formed in a base of a like window-well module to be stacked atop the ledge. Each upwardly directed projection from a lower window well module, when disposed into an associated indentation of a window well module stacked on it, stabilizes the window well modules, providing superior stability to counteract lateral forces. When stacked, the projection-into-indentation relationship neutralizes most module-manufacturing "errors."

Embodiments of the present subject matter are directed to a curvilinear area-well system including a plurality of vertically stacked units or modules that allow for hydrostatic pressure release from standing water outside of (and closely adjacent to) the area-well system, thereby preventing water pressure from building (which might) collapse stacked area-well modules. This feature enables a first region located within the curvilinear inner wall surfaces of the stacked area-well modules to dry more quickly than a second region located beyond curvilinear outer wall surfaces (of stacked units of the area-well system).

In window well modules of the present subject matter, the ledge includes several integral pads spaced along the ledge upper surface, for providing an air gap. These pads also serve as load-bearing surfaces, to compensate for manufacturing-tolerance "issues."

In embodiments, a window-well module of the present subject matter includes a curved wall. The curved wall defines an inner-wall section and at least two outer-wall sections. These outer wall sections include upper and lower outer-wall sections. The curved wall also defines an upper-surface section that is unitary with the inner-wall section and the upper outer-wall section. The curved wall further defines a ledge unitary with the upper and lower outer-wall sections. The ledge defines one or more integral projections extending from it. The curved wall also defines a base unitary with the inner-wall section and the lower outer-wall section. The base includes an underside configured to engage with one or more integral projections extending from a surface of a ledge of a second window-well module. The window-well module includes a cover pivotable about an axis spaced from the upper-surface section. The curved wall further defines opposite end portions disposed transverse to the curved wall. The end portions are dimensioned and configured for mounting the window-well module to structural components of a building.

BRIEF DESCRIPTION OF THE FIGURES

Throughout the FIGS. and detailed description (below), I will use similar reference numerals to identify related components and embodiments of the present subject matter.

DETAILED DESCRIPTION

Figure 1:
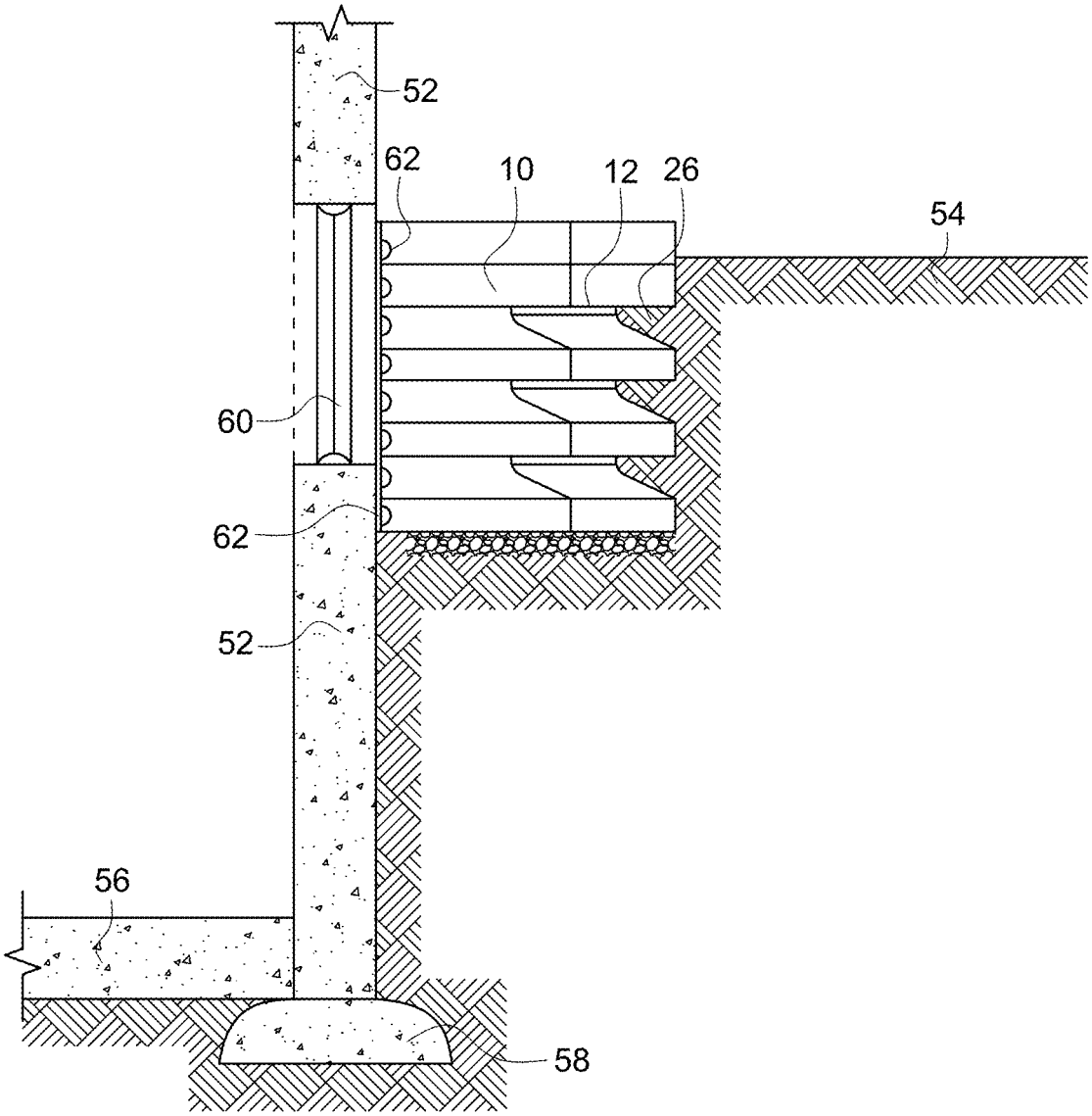
FIG. 1 (PRIOR ART)
FIG. 1 illustrates an example of a prior art window well in its typical environment.

U.S. Pat. No. 6,484,455 to Poole (disclosing rigid window wells and mentioned above) provides background regarding an environment for the present subject matter. Attention is therefore directed to FIG. 1 which depicts an exemplary window well structure 10 that includes escape steps 12 opposite a concrete foundation wall 52. Foundation wall 52 and window well structure 10 retain earth 54 exterior of the foundation wall 52. Interior of foundation wall 52, a concrete slab 56, serving as an interior below-grade floor, is shown; and foundation wall 52 is supported by a footing 58. Within an interior region defined by foundation wall 52 is a window 60 separated from retained earth 54 by the window well structure 10. Window well structure 10 is fastened to foundation wall 52 by fasteners 62. The step cavities 26 are contacted and then back filled by retained earth 54 in such a way that surrounding earth packs the cavities 26, to provide additional strength to steps 12.

Figure 2:
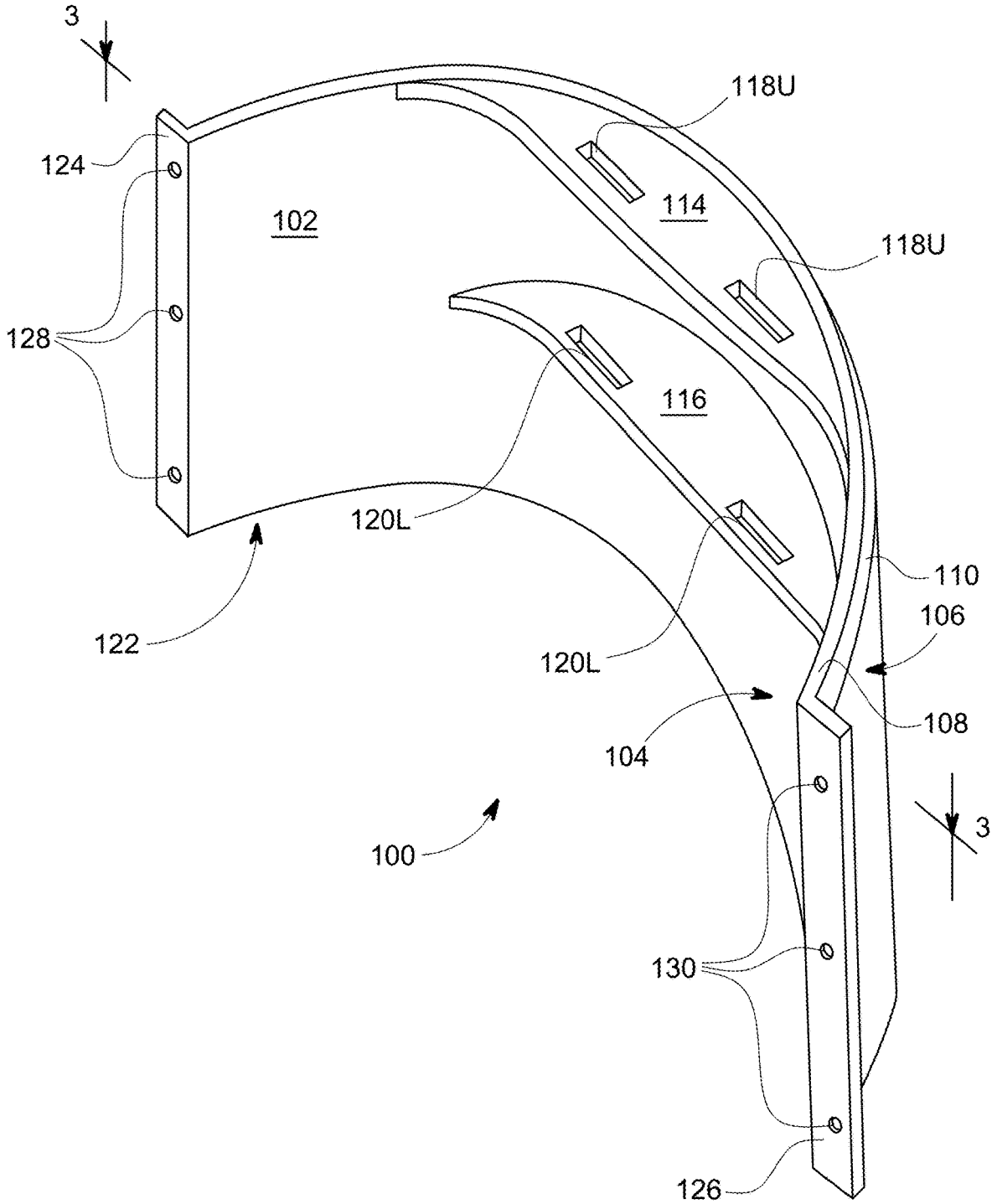
FIG. 2 presents a perspective view of an embodiment of the present subject matter.
Figure 3:
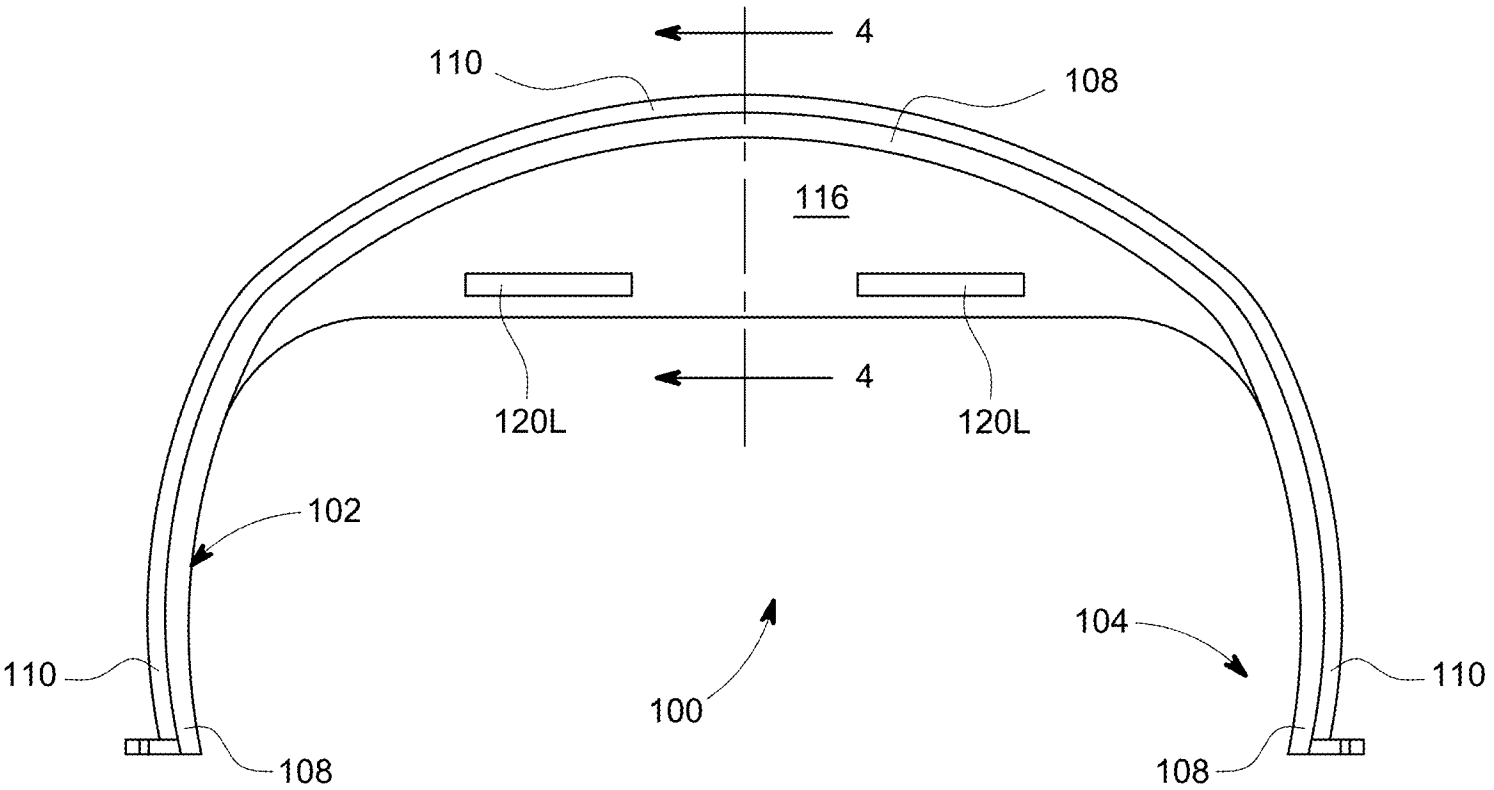
FIG. 3 depicts a plan view of the embodiment, from a plane 3-3 shown in FIG. 2.
Figure 4:
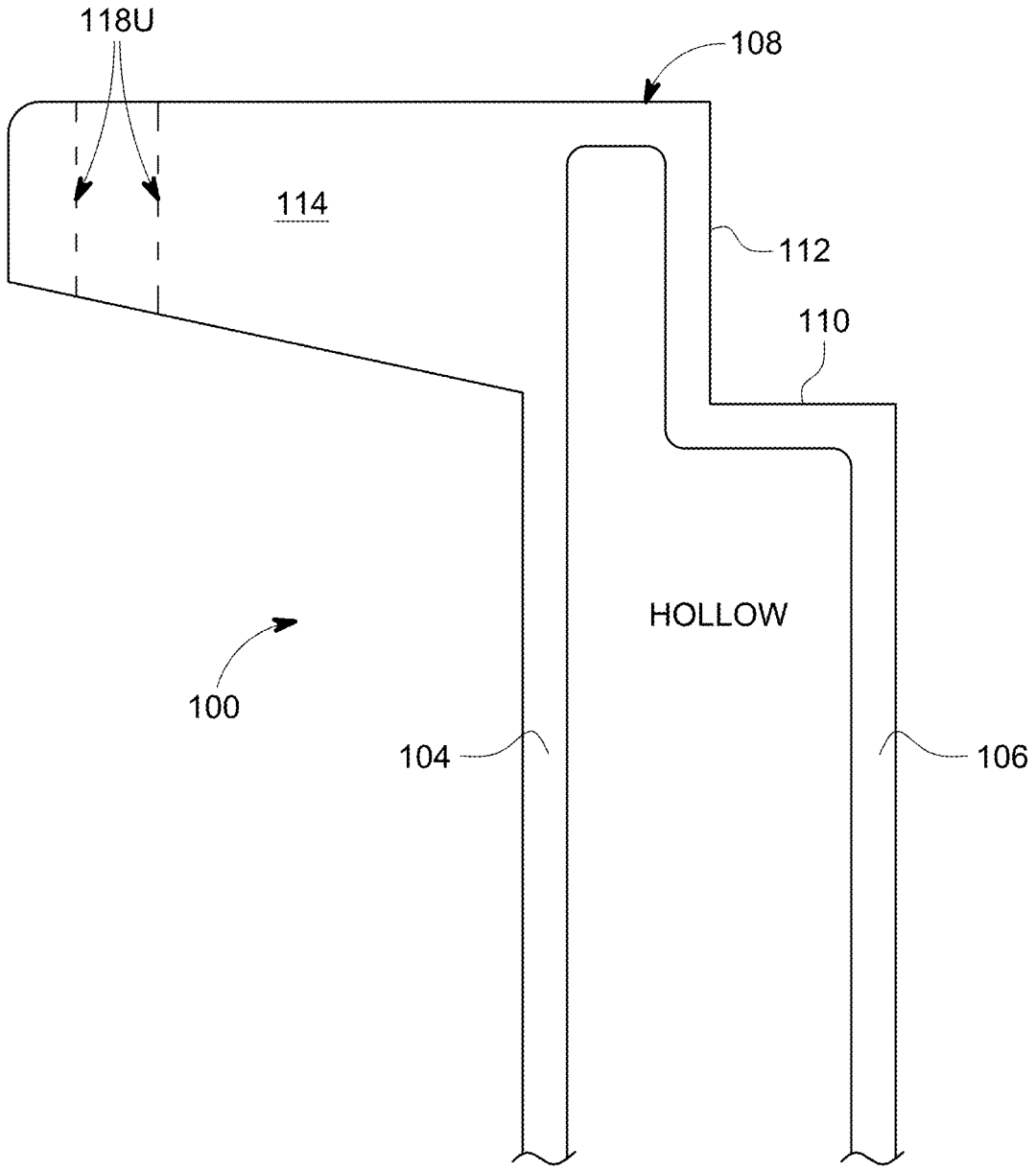
FIG. 4 presents a sectional view of an embodiment, from a plane 4-4 in FIG. 3.
Figure 4A:
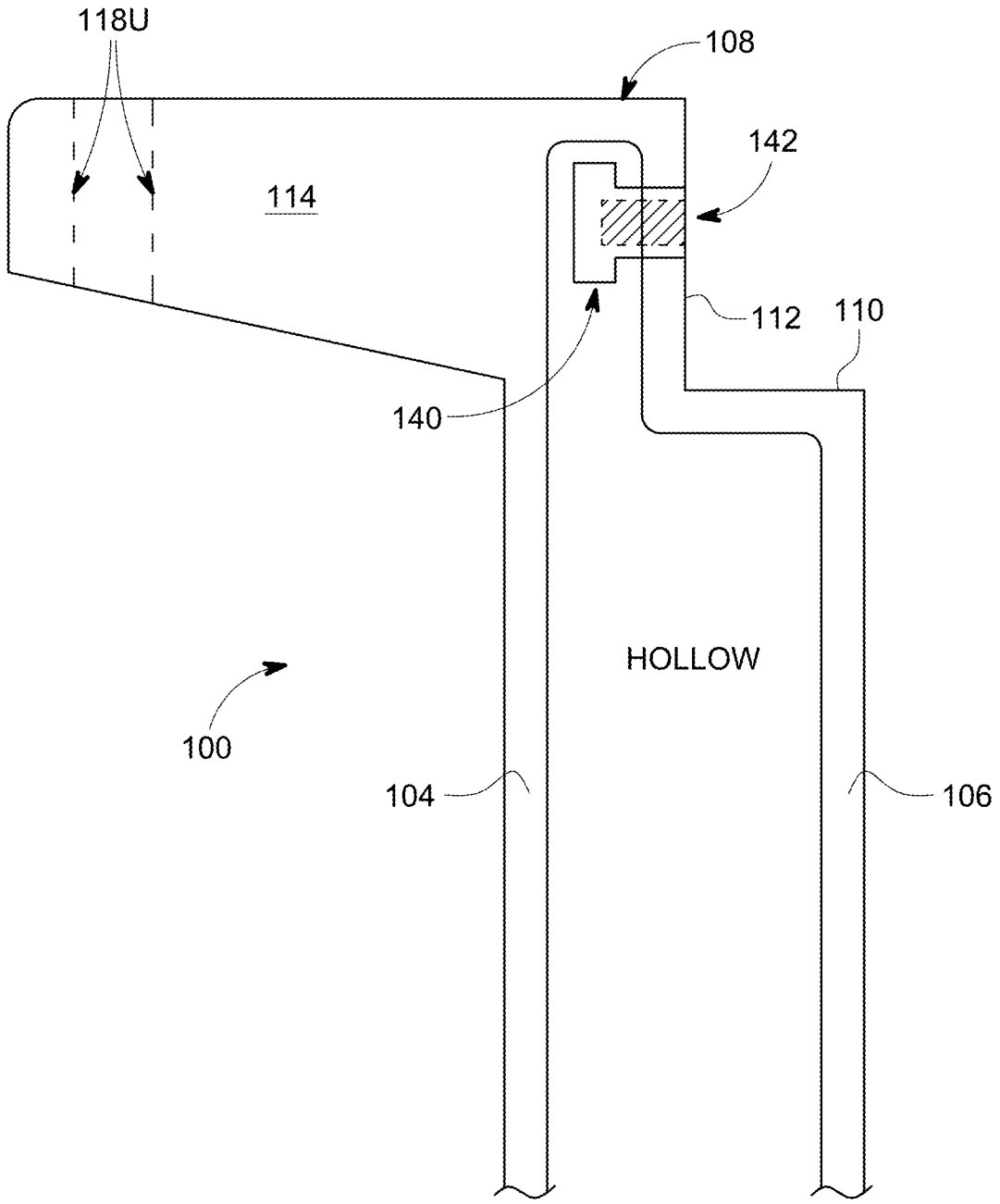
FIG. 4A is a sectional view of another embodiment, from the plane 4-4 in FIG. 3.

Attention is next directed to FIGS. 2, 3, 4, and 4A for a detailed description of the present subject matter. A unitary window well 100 (FIGS. 2, 3) includes a vertically oriented sidewall 102. The vertically oriented sidewall 102 includes an interior wall section 104 defining a curved surface with respect to a horizontal plane disposed transverse to the vertically oriented sidewall 102. The vertical sidewall 102 also includes a horizontally disposed upper surface section 108 (FIGS. 2, 3, 4, and 4A) which is unitary with the interior wall section 104 (FIGS. 2, 3). The vertical sidewall 102 also includes a vertically disposed upper exterior wall section 112 (FIGS. 4, 4A). The vertical sidewall 102 also includes a vertically disposed wall section 106 that is spaced below the upper wall section 112. Vertical sidewall 102 (FIG. 2) also includes a horizontally disposed ledge 110 which is unitary with the upper exterior wall section 112 and the lower exterior wall section 106. The upper surface section 108 and the ledge 110 (FIGS. 2-4) together provide the vertically oriented sidewall 102 with vertically stepped, horizontally disposed curvilinear surfaces 108, 110 (FIGS. 2, 3, 4, 4A) located atop upper surfaces of the vertically oriented sidewall 102 (FIGS. 2, 3) and above the lower exterior wall section 106 (FIGS. 4, 4A), respectively, with the ledge 110 being spaced, for example, about ¼ to 2 inches below the upper surface section 108 and extending away from upper exterior wall section 112.

In embodiments, the unitary window well 100 of the present subject matter includes a horizontally oriented first lateral support member 114 unitary with upper surface section 108 (FIGS. 2, 4) and at least one "other" horizontally oriented lateral support member 116 (FIGS. 2, 3) spaced below and substantially parallel to the first lateral support member 114. If there is more than one "other" lateral support member 116 (although the illustrated embodiment depicts only one such "other" lateral member 116), all such "other" lateral support members 116 are integral with the vertically oriented gently curved wall 102.

Figure 5:
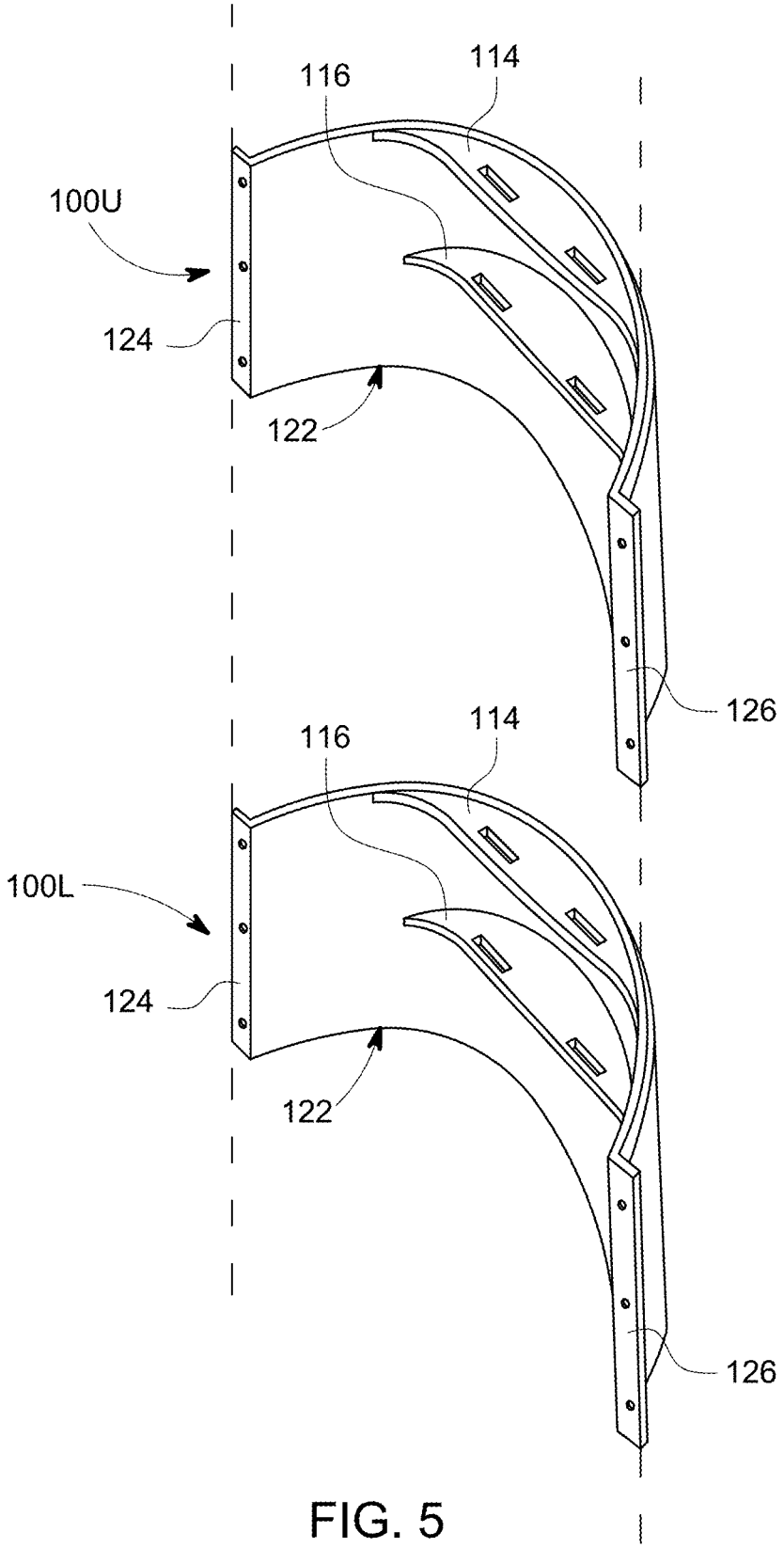
FIG. 5 is an exploded, perspective view of the embodiment of FIG. 2, shown as a system of vertically stacked window well modules, pursuant to the present subject matter.

Attention is next directed to FIG. 2, where another feature of the present subject matter is shown. For the unitary window well 100 units (or modules) of the present subject matter, the horizontally oriented lateral members 114 and 116—that a person of ordinary skill in the art ("POSITA") may refer to as "steps"—were designed to extend away from the vertical sidewall 102 (FIG. 3) by a predetermined distance, to provide to a person stepping onto either the lower or the upper horizontally oriented lateral member 114 (FIG. 2, 4) or 116 (FIGS. 2, 3) a secure foothold for egress from a basement. The upper and lower horizontally oriented lateral members 114, 116 each thus include at least two spaced apart, elongated openings (or apertures) 118U (FIG. 2) and 120L (FIGS. 2, 3), associated with the upper and lower horizontally oriented lateral member 114 and 116, respectively, with each of the openings for 118U (and for 120L) being dimensioned and configured for enabling an adult person to extend a palm sufficiently through, for enabling his/her fingers to securely grasp the lateral members 114 and/or 116 for proceeding upwardly. Thus, in accordance with the present subject matter, the unitary window well 100 (FIG. 2) is especially designed as a unit or module of a larger system that includes at least one other unitary window well serving as a first or lower unitary window well 100L, upon which is mounted a second or upper unitary window well 100U, as shown in FIG. 5.

Figure 6:
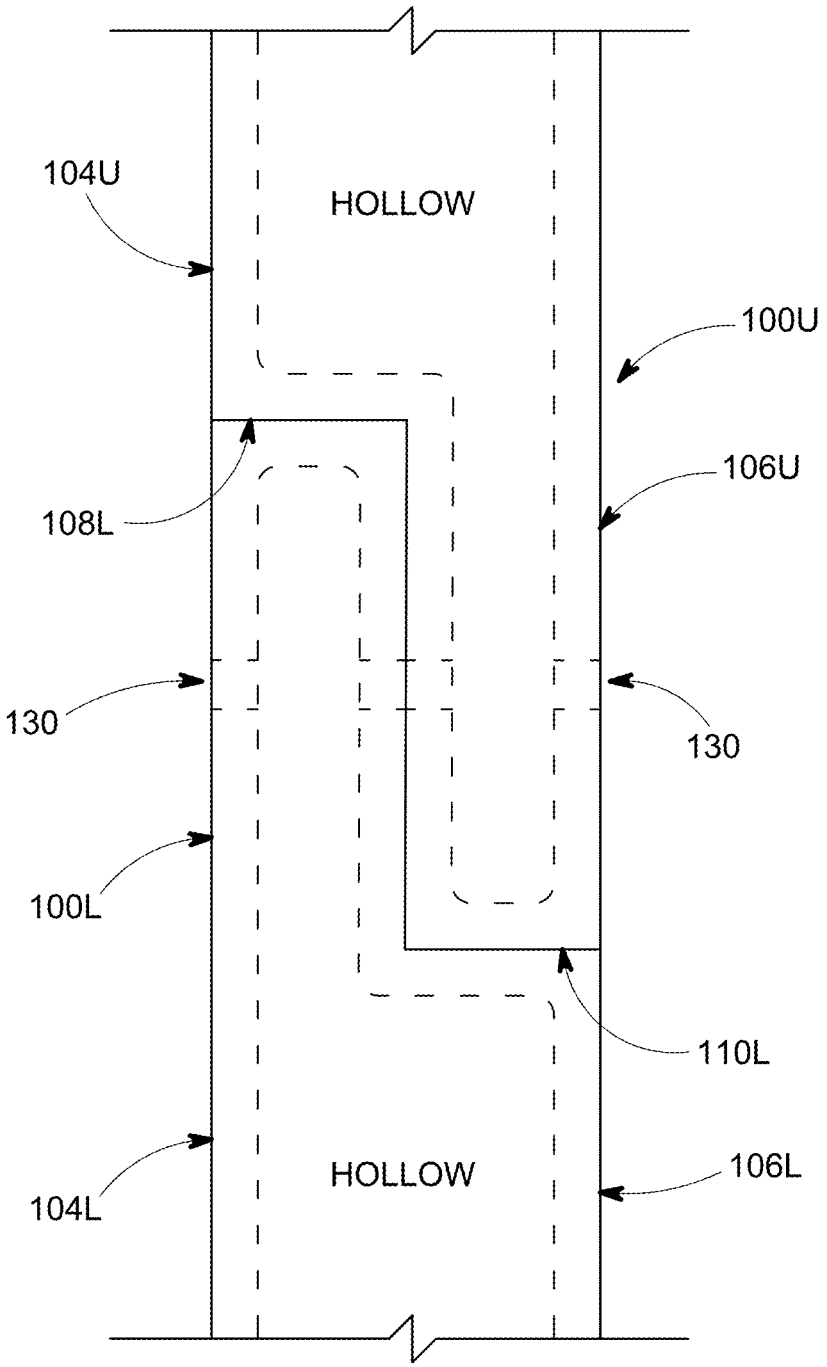
FIG. 6 is a partially fragmented sectional view of a structural detail based upon the embodiment of FIG. 5 after the vertically stacked window well modules have been joined.
Figure 6A:
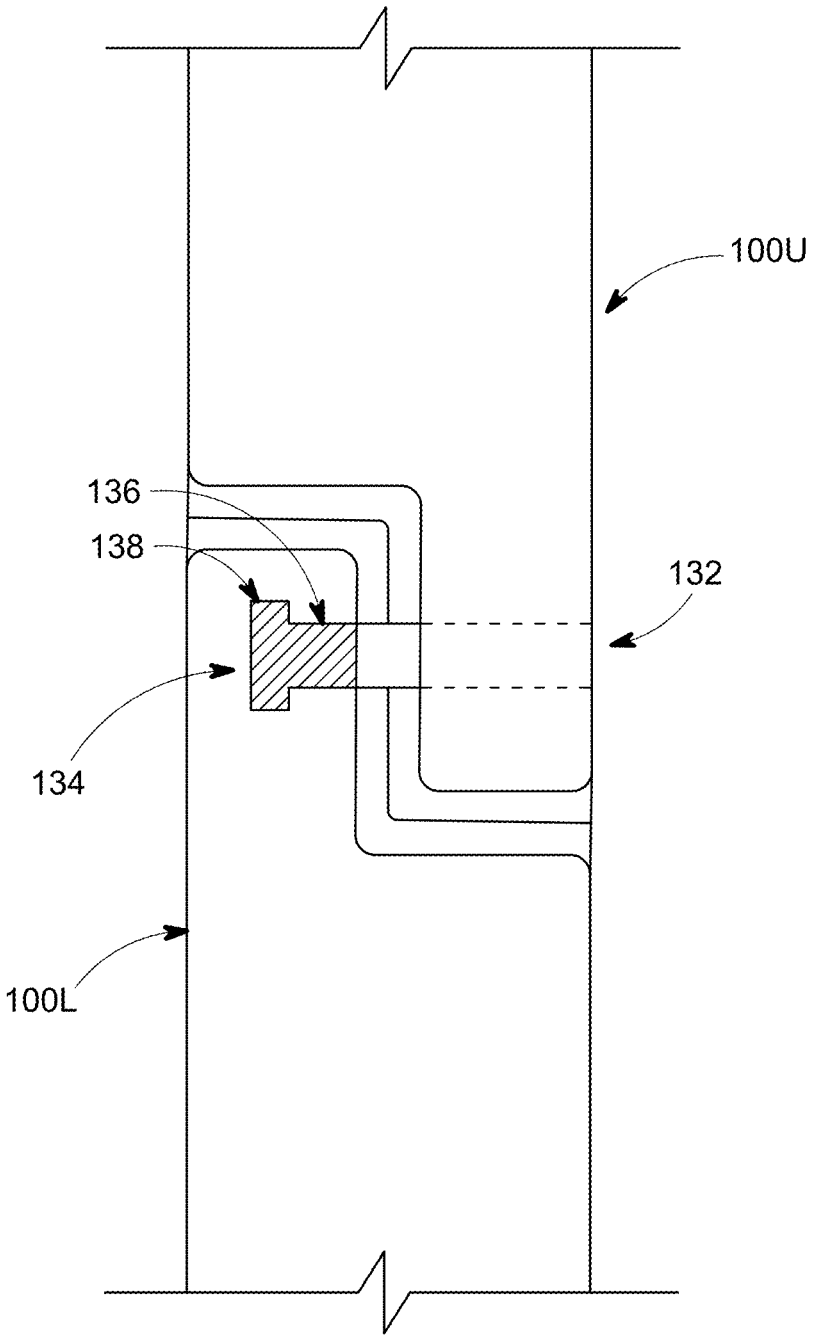
FIG. 6A is a partially fragmented sectional view of another structural detail based on the embodiment of FIG. 5 after the vertically stacked window well modules are joined.

See FIGS. 6 and 6A for details as to how vertically stacked window well modules 100L and 100U are secured together. In FIG. 6, note that window well modules 100L and 100U are both hollow, an advantage over the prior art. Consider, e.g., the '300 patent to Hawkes, disclosing a prior art window well "weighing less than about 400 pounds," typically installed by one, two or perhaps three workers "without requiring a crane or other lifting device." The design of my window well modules 100L and 100U, in sharp contrast, provides a distinct advantage over such prior art window well modules. My hollow design between the interior wall 104 and exterior wall 106 (FIGS. 4, 4A) provides a lightweight double-walled structure for the window well modules 100L, 100U of the present subject matter, which possess structural strength to more than meet ordinary stresses that occur.

While current embodiments of the window well modules 100L, 100U of the present subject matter have wall sections that are about 0.25 inches thick, a POSITA knows that wall thickness may be modified (e.g., increased) to reduce stress (e.g., load, impact, etc.) caused by an assortment of events or occurrences while in use. In addition, a POSITA (person of ordinary skill in the art) is aware it may at times be desirable to fill the hollow region between interior and exterior walls 104, 106 (FIGS. 4, 4A) with a polymeric material including but not limited to polyamide, polyethylene, polypropylene, and polyurethane.

FIG. 6 illustrates how an underside surface of an upper window-well module 100U is dimensioned and configured to mesh (as an "interference fit") with the upper surfaces—i.e., the upper surface section 108L and ledge 110L—of a lower window well module 100L. In one embodiment, a threaded fastener, e.g., a machine screw (not shown), can be disposed through bore 130 to removably secure upper and lower window-well modules 100U, 100L together. In another embodiment (FIG. 6A), one of the window-well modules 100U or 100L, for example, upper window well module 100U, could include an aperture or opening 132, while the other, lower window well module 100L could include an internal, embedded receptacle 134 having an internally threaded barrel 136 integral with an annular base 138. Annular base 138 can have a diameter greater than the diameter of barrel 136. Thus, a fastener, such as a machine screw (not shown), could be screwed into barrel 136, to secure upper and lower window-well modules 100U and 100L together.

In embodiments, upper surface section 108 of window-well module 100 of the present subject matter can include a similar internal, embedded receptacle 140 adjacent to ledge 110 (FIG. 4A) to enable a threaded fastener (not shown) to be located in opening 142 through vertically oriented exterior sidewall portion 112 that is unitary with ledge 110.

Let us briefly now return to FIG. 1 to consider the '455 patent to Poole. If window 60 extends downwardly, e.g., 4 to 8 feet, from where fixed to foundation wall 52, a window well escape system comprising an upper unitary window well unit or module 100U and a plurality (i.e., two or more) lower unitary window well units or modules 100L, of the present subject matter, vertically stacked or arranged in an excavated space or region within the soil or earth 54 (and located adjacent to the window 60), would now extend downwardly. Let us also imagine that such an extended window 60 can pivot about an axis (not shown) located along an upper or lower region of window 60, for enabling an opposite portion of the window 60, located by a floor or concrete slab 56, to swing away from foundation wall 52, for enabling at least one person to escape through the window using, e.g., a vertically stacked arrangement of upper and lower window well modules 100U, 100L of the present subject matter which will provide all such persons with a ladder having a sufficient number of footholds 114, 116 (please see FIG. 5) and handholds 118U, 120L (see also FIG. 2).

Next, briefly returning to FIG. 2, each unitary window well unit or module 100 of the present subject matter has a base 122 unitary with one of, or both of, the inner wall 104 and outer wall 106 sections of curved vertical wall 102. In addition, each unitary window well unit or module 100 has a pair of integral flanges 124, 126 that are located at opposite ends of the curved vertical wall 102. One such flange 124 and one other flange 126 are each oriented transverse to curved wall 102, and each include a predetermined number of apertures or through bores 128, 130 for enabling a person to use conventional fasteners or fastener systems to secure a single window well 100, or a plurality of window wells 100, to structural elements of a basement window, as shown in U.S. Pat. No. 3,004,634 to Evans et al. or to an exterior wall as shown in U.S. Pat. No. 2,453,609 to Whitehouse. A person of ordinary skill in the art ("POSITA") knows of fastener systems that can be used.

Figure 7:
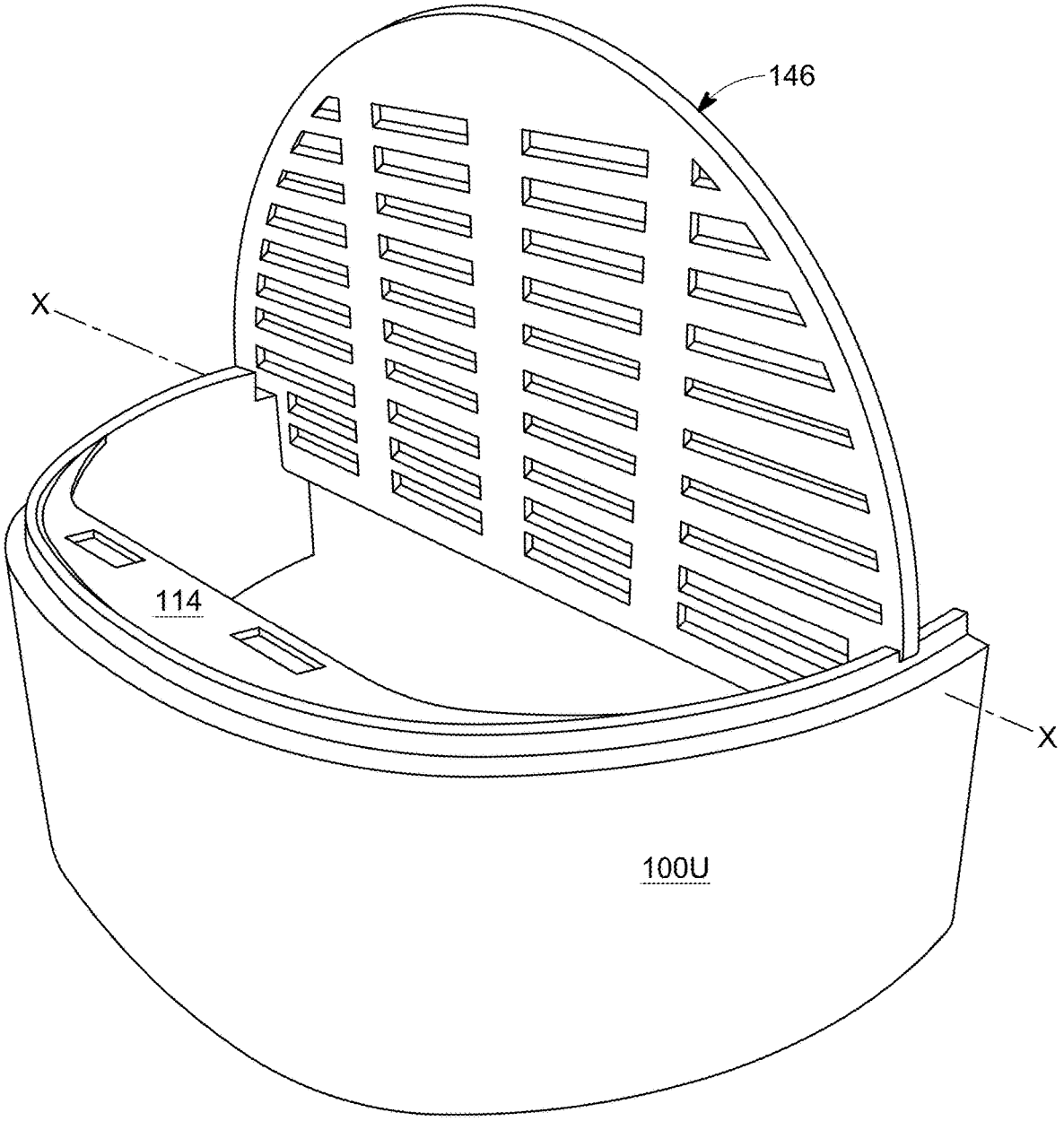
FIG. 7 presents a perspective view of a prototype of the window well of the present subject matter, based upon the illustrated embodiment shown in FIG. 2, including a cover.

In other embodiments of the present subject matter, an upper window well unit or module 100U could include a cover, such as a louvered cover 146 (FIG. 7), pivotable about an axis X-X spaced from upper horizontally oriented lateral stiffener member 114.

Figure 8:
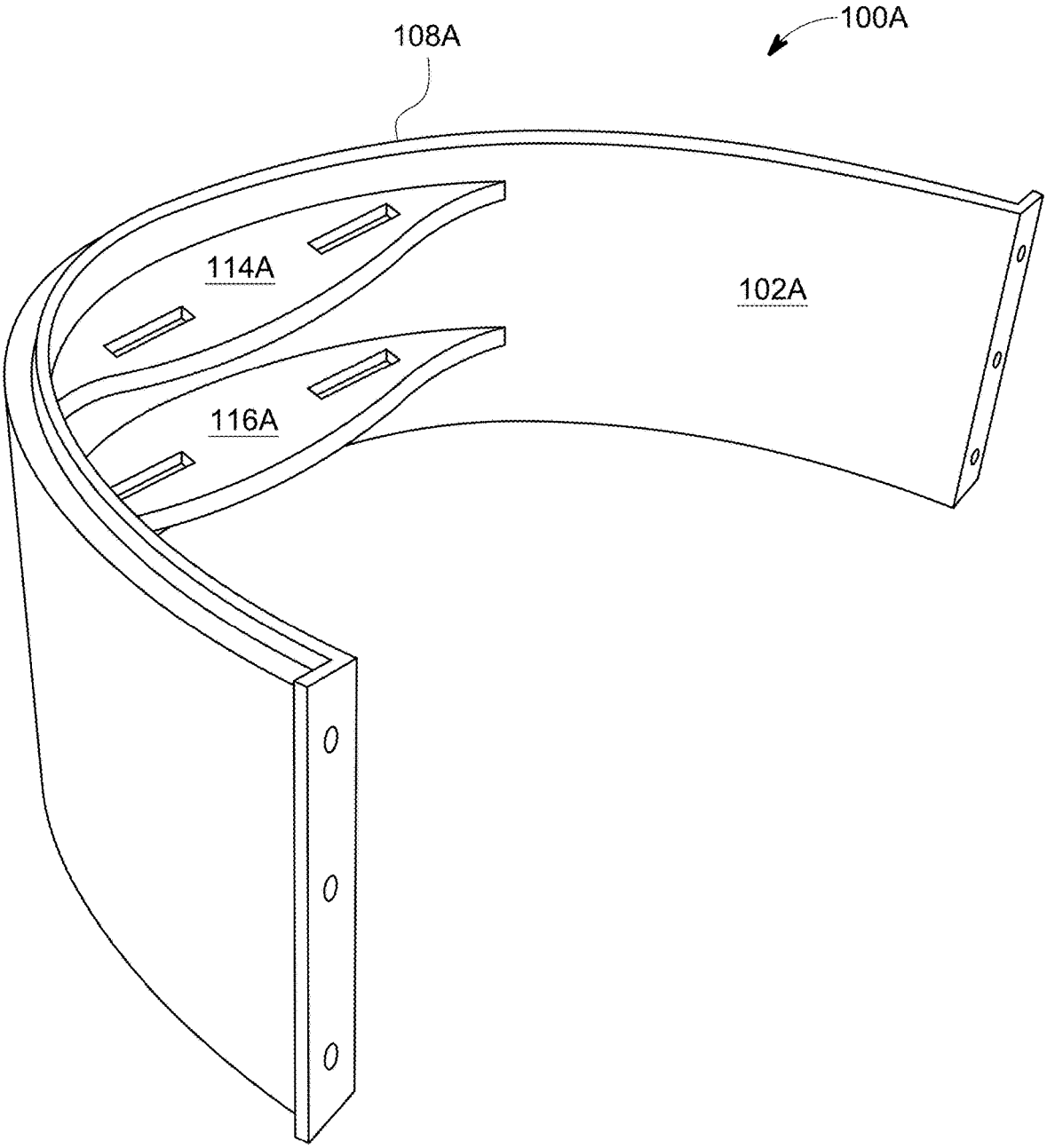
FIG. 8 is a perspective view of another example (i.e., yet another prototype) of a window well of the present subject matter, based upon the embodiment shown in FIG. 2.

In yet other embodiments of the unitary window well module 100A of the present subject matter, it is desirable that an upper, horizontally oriented lateral stiffener member 114A be spaced between an upper surface section 108A and a lower, horizontally oriented lateral member 116A, be unitary with the curved wall 102A, as shown in FIG. 8.

Figure 9:
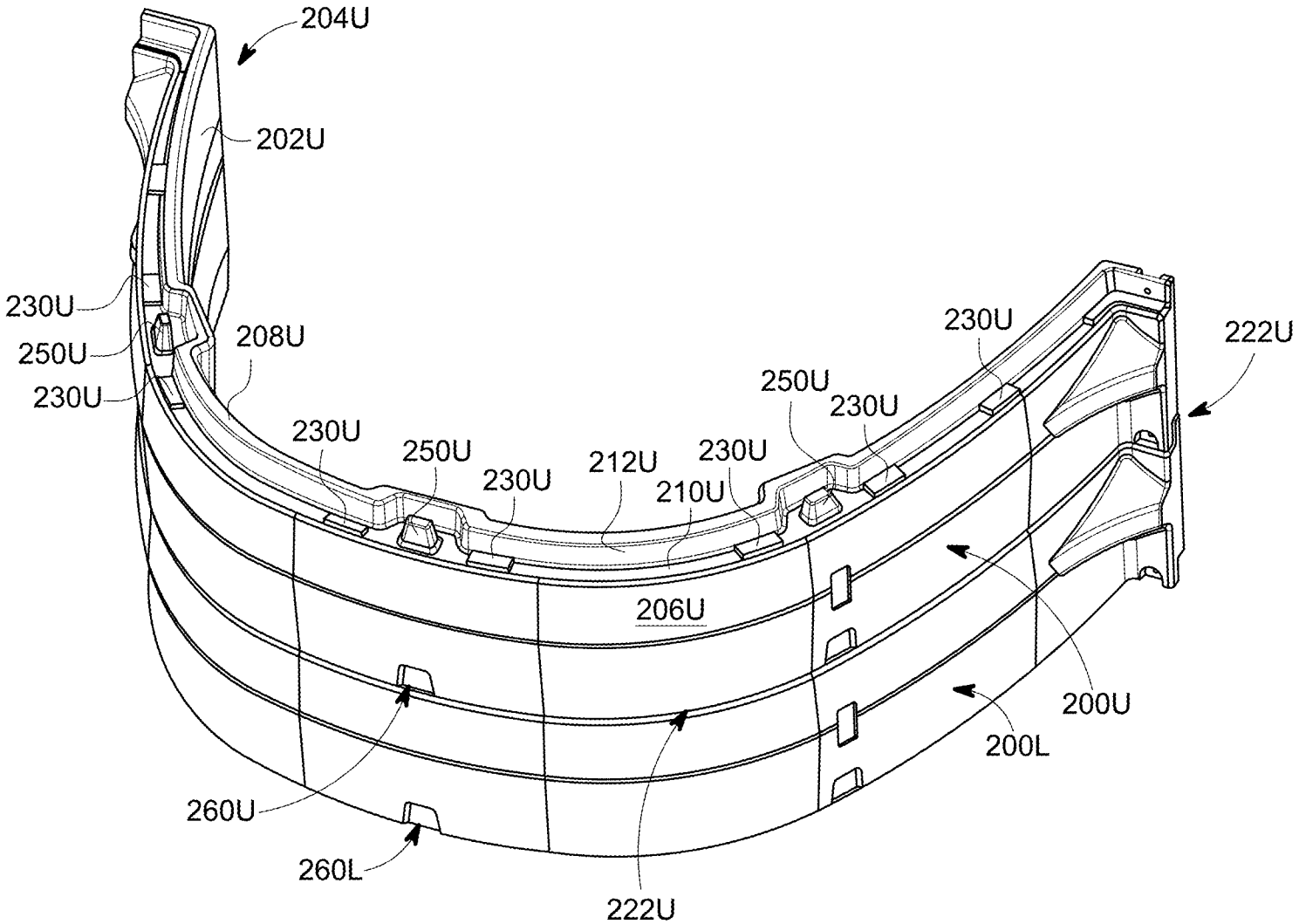
FIG. 9 is a perspective view of another embodiment of the present subject matter.
Figure 10:
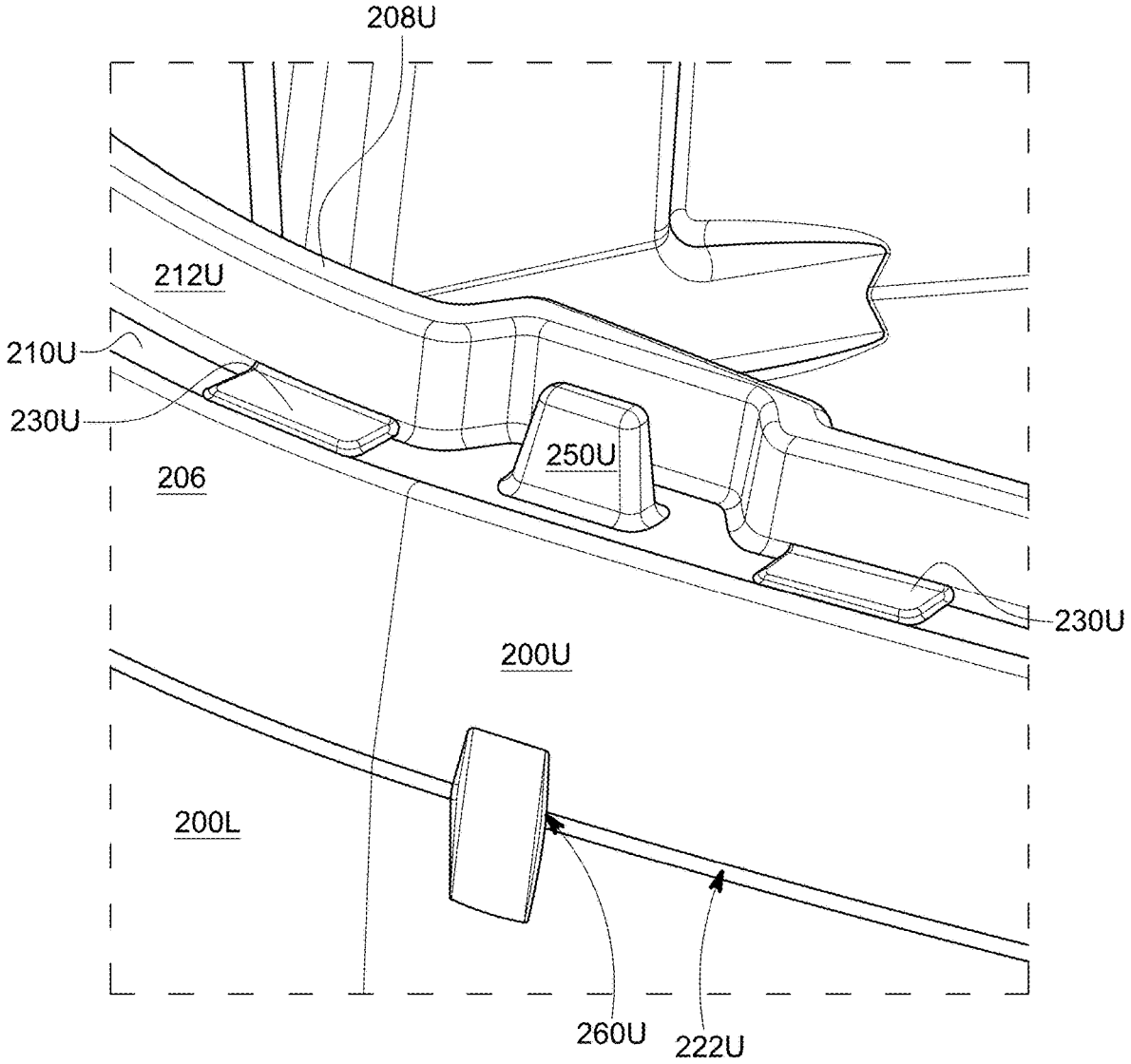
FIG. 10 presents details of the present subject matter (enlarged relative to FIG. 9).

FIGS. 9-16 present views of another embodiment of a stacked window well system of the present subject matter. In this embodiment, an upper (unitary) window well module 200U is shown mounted atop (FIG. 9) a lower (also unitary) window well module 200L. Upper module 200U (FIGS. 9, 12) includes a vertically oriented sidewall 202U including an interior wall section 204U defining a curved surface with respect to a horizontal plane disposed transverse to vertically oriented sidewall 202U. Vertically oriented sidewall 202U defines an interior wall section 204U having a curved surface with respect to a horizontal plane disposed transverse to vertically oriented sidewall 202U. Vertical sidewall 202U includes a horizontally disposed upper surface section 208U (FIGS. 9, 10) unitary with interior wall section 204U (FIG. 9). Vertical sidewall 202U (FIG. 9) includes a vertically disposed upper exterior wall section 212U (FIGS. 9, 10). Vertical sidewall 202U includes a vertically disposed wall section 206U spaced below upper wall section 212U (FIG. 9). Vertical sidewall 202U includes a horizontally disposed ledge 210 (FIGS. 9, 10) unitary with upper exterior wall section 212U and lower exterior wall section 206U. Upper surface section 208U and ledge 210U (FIG. 10) together provide vertically oriented sidewall 202U with vertically stepped, horizontally disposed curvilinear surfaces 208U, 210U (FIG. 10) located atop upper surfaces of vertically oriented sidewall 202U (FIG. 9) and above lower exterior wall section 206A, respectively, with the ledge 210U spaced, e.g., about ¼ to 2 inches below upper surface section 208U and extending away from upper exterior wall section 212U. The lower module 200L has identical structural components and features.

Figure 13:
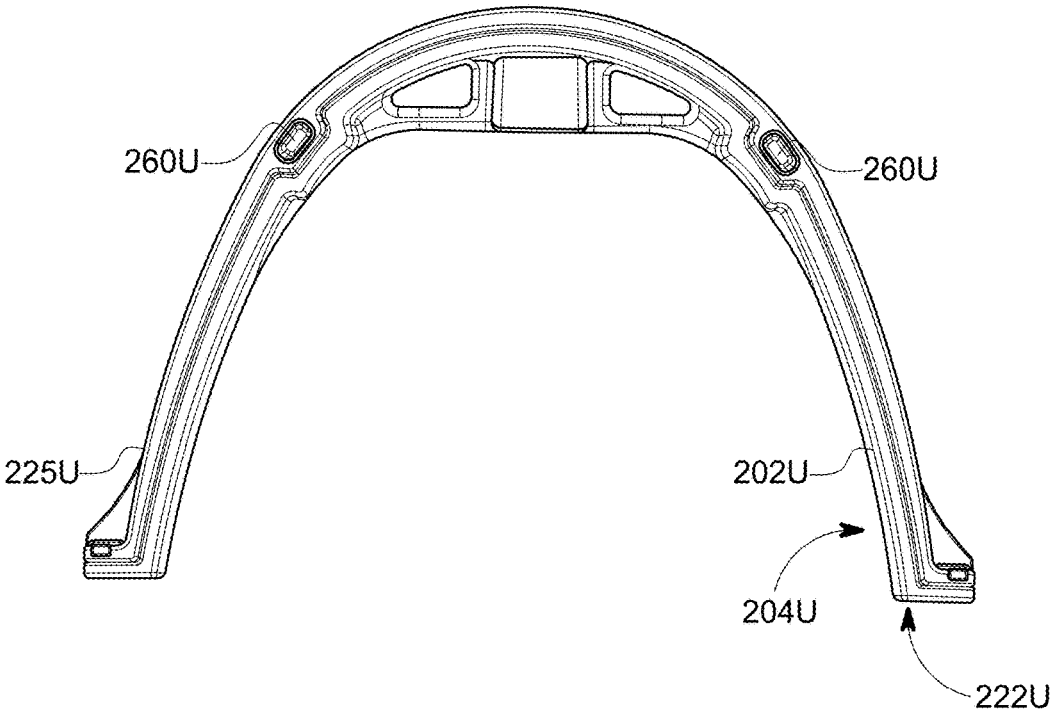
FIG. 13 presents an underside (plan) view of the embodiment depicted in FIG. 12.
Figure 14:
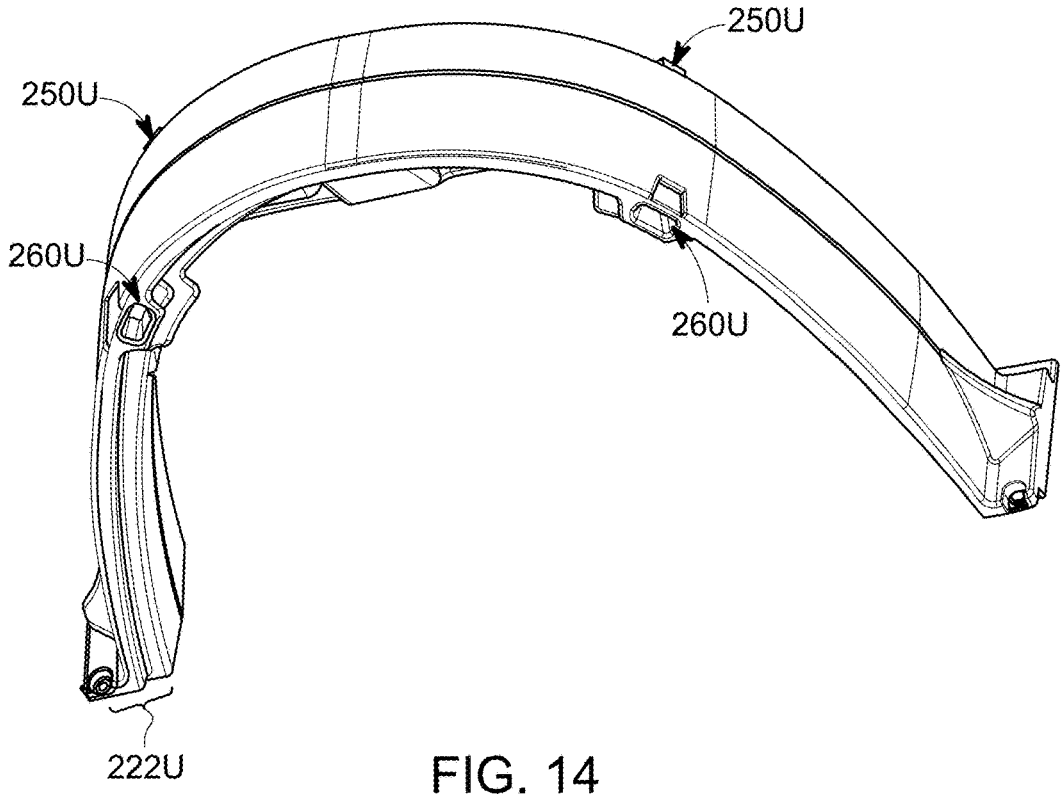
FIG. 14 is a bottom, perspective view of the embodiment shown in FIGS. 12, 13.
Figure 15:
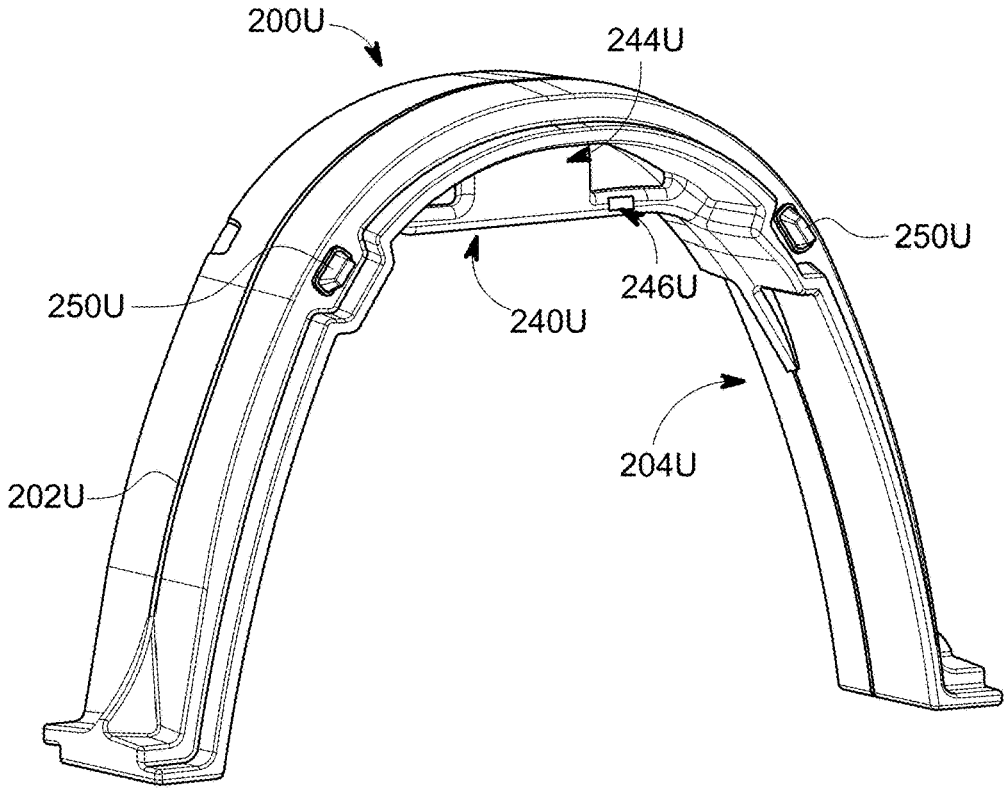
FIG. 15 is an upper, perspective view of the embodiment shown in FIGS. 12-14.

The upper exterior wall section 212U is unitary with the ledge 210U (FIG. 10) and extends outwardly from the exterior wall section 212U. The vertically oriented sidewall 202U includes a base 222U that is "stepped" (FIGS. 9, 13), for enabling the base 222U to be unitary with the interior wall section 204U as well as an exterior wall portion 225U closely adjacent to the base 222U (FIG. 13). The stepped base 222U of the upper module 200U is designed and configured to engage upper surface portions of a second window well. The lower module 200L has identical structural components and features. (FIG. 9).

Figure 12:
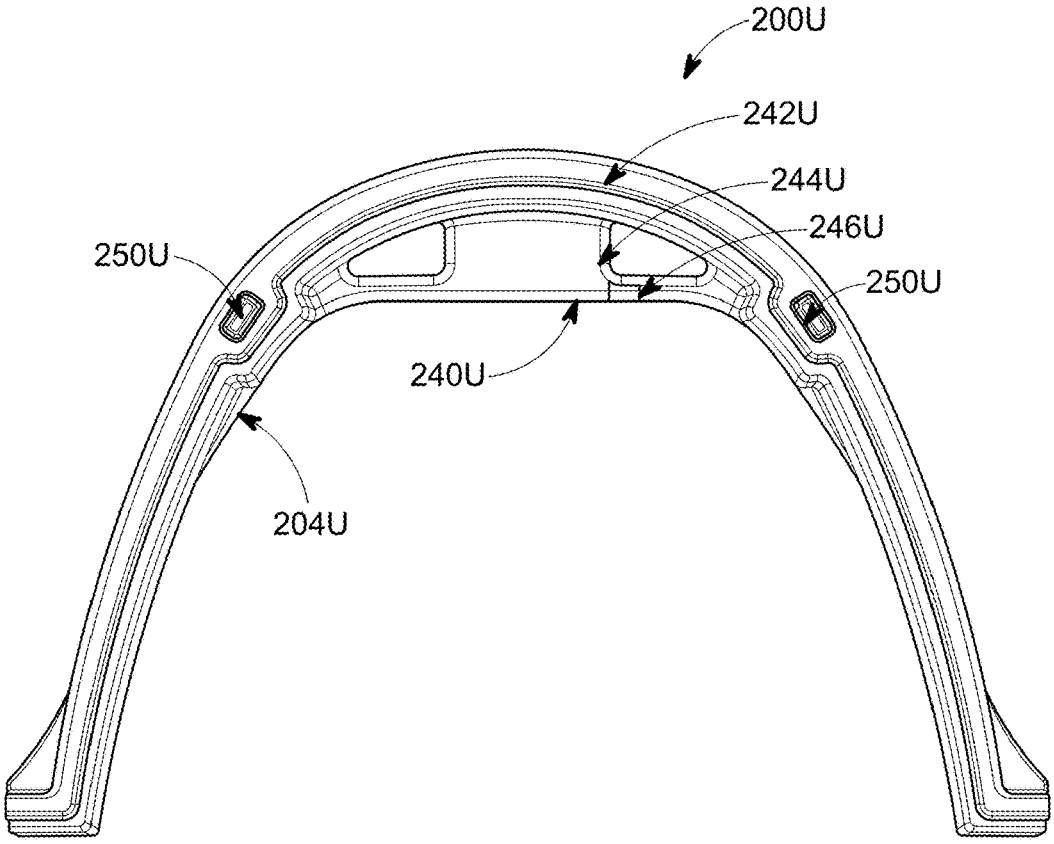
FIG. 12 is a top (plan) view of another embodiment of the present subject matter.

In embodiments, an upper window well module 200U can include an upper step 240U unitary with interior wall section 204U (FIG. 12), where the step 240U includes a raised traction element 242U, a brand identifier 244U, and a size identifier 246U (FIG. 12).

Figure 11:
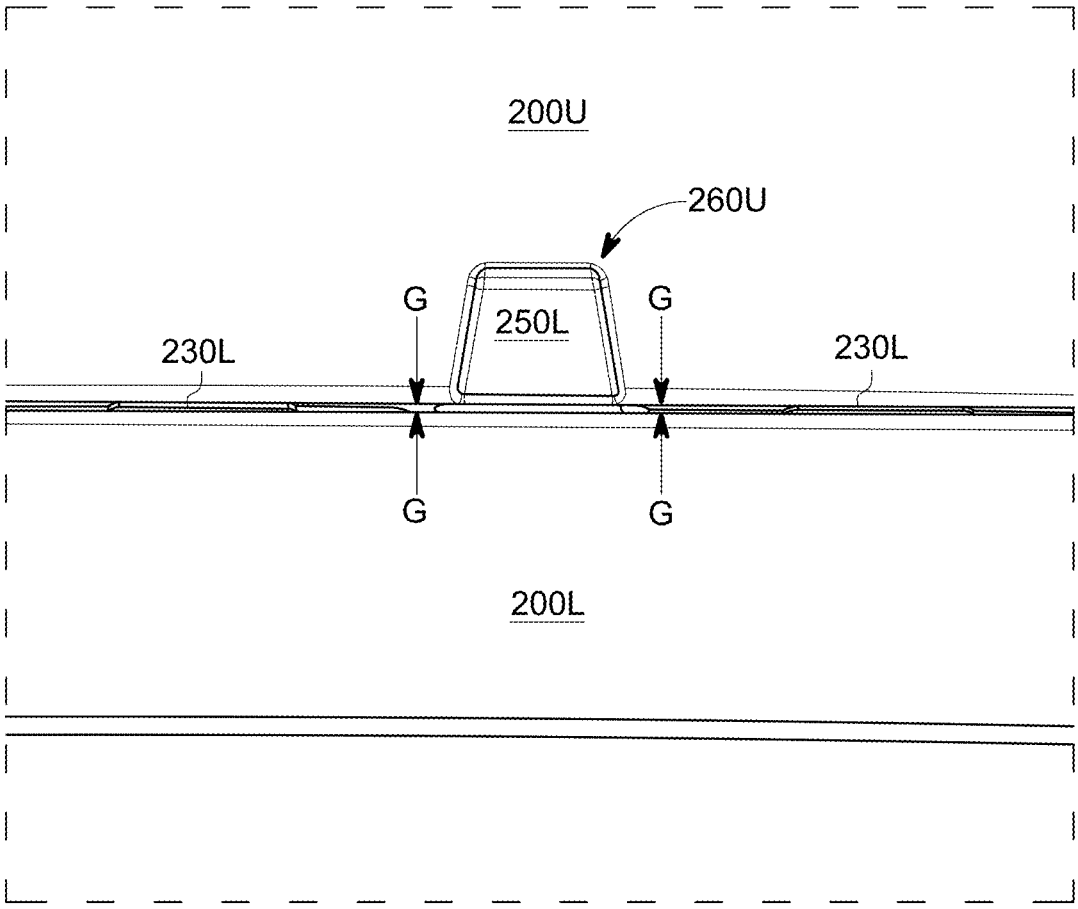
FIG. 11 is a side elevation view showing certain enlarged details shown in FIG. 10.

Let us now investigate FIGS. 10 and 11 which illustrate, in detail, select features shown in FIGS. 9 and 12-15 on a dimensionally reduced scale. The ledge 210U includes, for example, at least one integral "tooth" (or projection) 250U (FIG. 10) and preferably a plurality of "teeth" (or projections) 250U (FIGS. 9, 14, 15), where each tooth or projection 250U is unitary with the ledge 210U and is curvilinearly spaced along (and extends away from) the ledge 210U. Each module 200L, 200U includes a curved wall 202L and 202U, having an inner wall section 204L and 204U, an upper surface section 208L and 208U that is unitary with the inner wall section 204L and 204U, and a base 222L and 222U that defines a plurality of cavities or indentations 260L, 260U. Each projection 250L of a lower module 200L, e.g., is dimensioned and configured to mesh with and fit into associated indentations 260U (FIG. 13) of a window well module 200U (FIG. 11) placed on top of it.

In embodiments of the present subject matter, a plurality of weight-bearing pads 230U (FIG. 9, 10) and/or 230L (FIG. 11) are spaced along the ledge upper surface 210U (FIG. 9) of a window-well module 200L and 200U. The plural weight-bearing pads provide an air gap "G" (FIG. 11) between upper and lower contacting surface portions of the upper and lower window-well modules 200U, 200L. The weight-bearing pads 230U and/or 230L thus serve as load-bearing surfaces, to compensate for manufacturing-tolerance issues.

Figure 16:
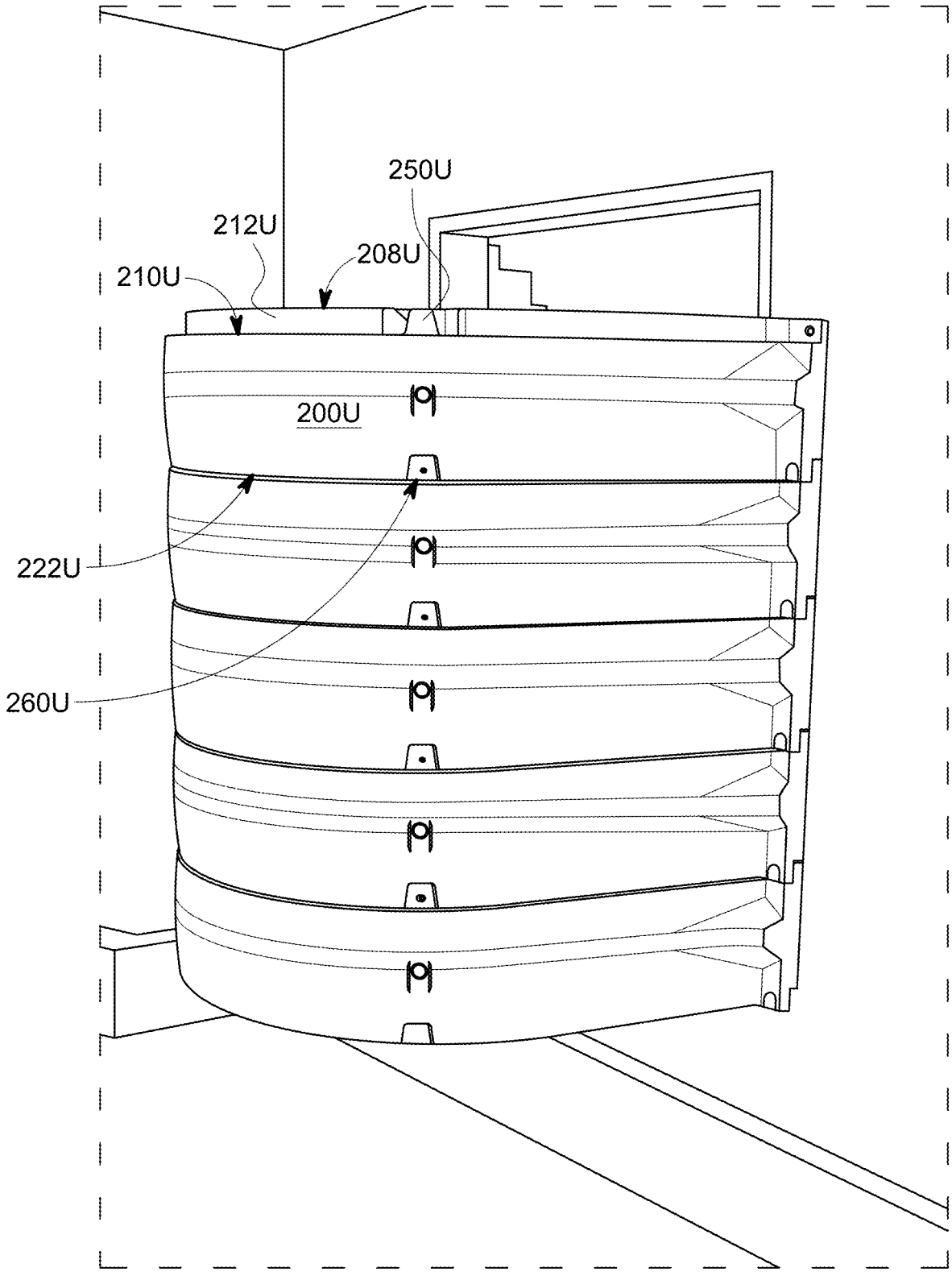
FIG. 16 is a side-elevational (exterior corner-portion) view of a system comprising several vertically stacked curvilinear area-well unit modules of the present subject matter.

FIG. 16 is an exterior corner-portion, side elevational view of a system comprising several vertically stacked curvilinear area-well unit modules of the present subject matter.

A variety of embodiments of the unitary window well units or modules of the present subject matter can be manufactured by several commercial processes including but not limited to blow molding, injection molding, and rotational (also known as "roto") molding.

In addition, an assortment of embodiments of the unitary double-walled window well units or modules of the present invention could, for example, be made of such lightweight materials as cast aluminum or polyolefin, a type of polymer having the general formula (CH2CHR)n. Polyolefins are derived from olefins (also known as alkenes, a type of monomer having a double bond for making polymeric materials). The more dominant polyolefins, in a commercial sense, include polyethylene and polypropylene. Polyolefins having "specialized" properties are polybutene, polyisobutylene, and polymethylpentene.

Accordingly, for certain embodiments it may be desirable to manufacture window wells of the present subject matter from a material selected from the group consisting of polyethylene (e.g., high density polyethylene), polypropylene, polybutene, polyisobutene, polymethylpentene, aluminum (cast or not), a sintered metal, a composite, and graphene.

It could be economical to produce window well modules by three-dimensional ("3D") printing methods, also known as additive printing. Well known 3D printing methods, used to manufacture useful articles from alumina, zirconia, zircon (i.e., zirconium silicate), and silicon carbide are described in U.S. Pat. No. 5,387,380 to Cima et al. In addition, known 3D printing methods used to make various products from Al/Mg particles coated by metal (i.e., copper, nickel, zinc, or tin) are described in U.S. Pat. No. 7,141,207 to Jandeska et al.

Illustrated and described throughout this patent specification are embodiments of a window well system. The system includes two or more window well modules vertically arranged. Each module includes a curved wall having an inner wall section, an upper wall section unitary with the inner wall section, and a base defining a plurality of indentations. The curved wall includes an outer wall section unitary with the upper wall section. Between the inner and outer wall sections is an air space. The outer wall section includes a ledge along which a plurality of projections is arranged. The plural projections are dimensioned and configured to mesh with and fit into each associated one of the plurality of indentations of a window well module mounted immediately above it. While the system has been described with reference to exemplary embodiments, the present subject matter is not limited to embodiments described. On the contrary various alternatives, changes, and modifications will become apparent to a person of ordinary skill in the art ("POSITA") after this patent application has been read and the figures reviewed. Therefore, alternatives, changes, and modifications are to be considered as forming a part of the present subject matter insofar as they fall within the spirit and scope of appended claims.

I claim:

1. A window-well system comprising at least two vertically stacked window-well modules, wherein one of the at least two vertically stacked window-well modules is an upper window-well module and another one of the at least two vertically stacked window-well modules is a lower window-well module, and wherein each of the at least two vertically stacked window-well modules comprises:

a curved wall defining:

a curved inner-wall section, a curved outer-wall section spaced from the inner-wall section;

a curvilinear upper-surface section unitary with the inner-wall section;

a curvilinear ledge spaced from the upper-surface section and unitary with the upper and lower outer-wall section, wherein the ledge defines two or more integral projections extending therefrom in a direction of the upper-surface section; and a curvilinear base spaced from the ledge and unitary with the outer-wall section, wherein the base defines an underside surface defining integral indentations configured to engagedly receive the two or more integral projections extending from the ledge of an upper window-well module stacked thereabove.

2. The window-well system of claim 1, including a cover configured to be associated with the upper window-well module and pivotable about an axis spaced from the upper-surface section of the upper window-well module.

3. The window-well system of claim 1, wherein the curved wall further defines opposite end portions disposed transverse to and extending radially outwardly from the curved wall, and wherein the end portions are configured for mounting the window-well system to a building structure.

4. The window-well system of claim 1, wherein the curved wall is manufactured from a material selected from the group consisting of aluminum, graphene, sintered metal, polymethylpentene, polyisobutylene, polyurethane, polyethylene, polypropylene, polybutene, and a composite, and wherein the curved wall further defines a hollow region located between the inner-wall section and the outer-wall section.

5. The window-well system of claim 1, wherein the inner-wall section and the outer-wall section each have a thickness of about 0.25 inches.

* * * * *